US005175973A

United States Patent [19]

Owen et al.

[11] Patent Number: 5,175,973

[45] Date of Patent: Jan. 5, 1993

[54] COMPRESSION REPAIR METHOD AND APPARATUS

[75] Inventors: Richard Owen; Richard C. Hanny, both of Houston; George Harrison, Alvin, all of Tex.

[73] Assignee: Team, Inc., Alvin, Tex.

[21] Appl. No.: 690,072

[22] Filed: Apr. 23, 1991

Related U.S. Application Data

[60] Continuation-in-part of Ser. No. 395,959, Aug. 17, 1989, Pat. No. 5,027,575, which is a division of Ser. No. 206,579, Jun. 14, 1988, Pat. No. 4,918,883.

[51] Int. Cl.[5] ..... E04B 1/00

[52] U.S. Cl. ..... 52/742; 405/216

[58] Field of Search ..... 405/216; 52/742, 514

[56] References Cited

U.S. PATENT DOCUMENTS

| | | | |
|---|---|---|---|
| 967,952 | 8/1910 | Moran | 405/216 |
| 2,109,508 | 3/1938 | Schmittutz | 52/742 |
| 4,306,821 | 12/1981 | Moore | 405/216 |
| 4,724,793 | 2/1988 | Sletten | 47/57.5 |
| 4,743,142 | 5/1988 | Shiraishi | 405/216 |
| 4,779,389 | 10/1988 | Landers | 52/742 |

FOREIGN PATENT DOCUMENTS

| | | | |
|---|---|---|---|
| 31943 | 3/1981 | Japan | 405/216 |

OTHER PUBLICATIONS

Polyurethanes by Dombrow copyright 1957 pp. 5-23.

*Primary Examiner*—David A. Scherbel
*Assistant Examiner*—Creighton Smith
*Attorney, Agent, or Firm*—Matthews & Assoc.

[57] ABSTRACT

This invention provides a method for repair for poles which have been damaged which is easily transportable, simple to install, and easily adaptable to many classes of poles. The method involves excavating around the pole, cleaning the surface of the pole, pumping a fumigant into the pole, cutting back to solid wood, installing a high compressive strength filler, applying a bonding agent to the clean surface, and then applying strips of a composite fiberglass mat and resin to the pole in a controlled manner until a desired encasement thickness has been achieved. The repair is completed by application of an ultraviolet resistance coating to the pole.

21 Claims, 2 Drawing Sheets

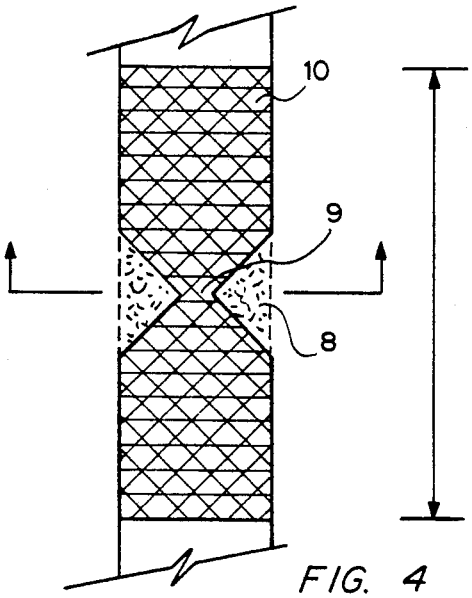
FIG. 4
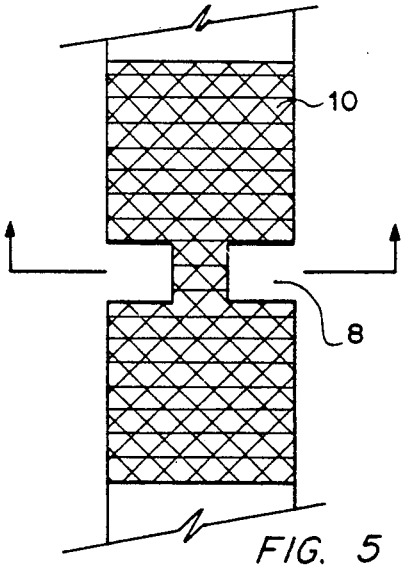
FIG. 5
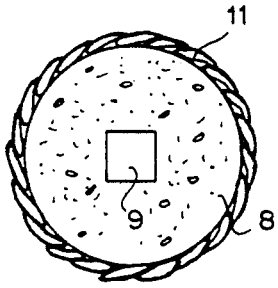
FIG. 6
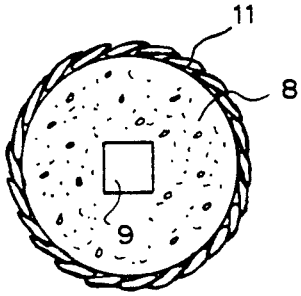
FIG. 7
FIG. 8
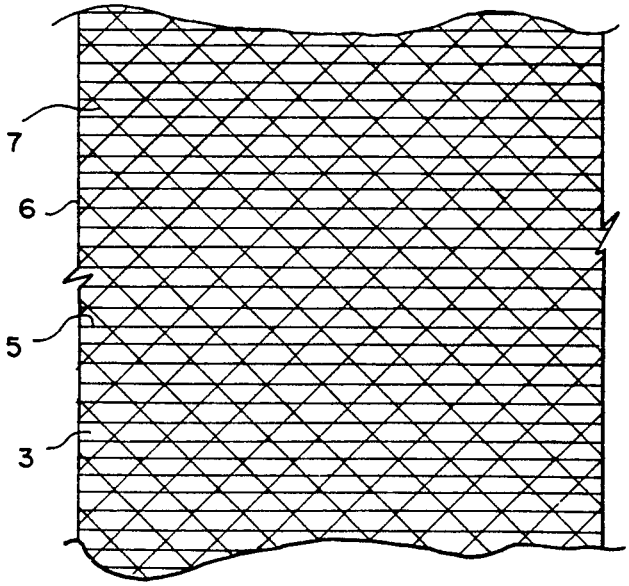

COMPRESSION REPAIR METHOD AND APPARATUS

This application is a continuation in part of Ser. No. 07/395,959 filed Aug. 17, 1989, U.S. Pat. No. 5,027,575 which is a divisional application of application Ser. No. 07/206,579 filed Jun. 14, 1988 which issued as U.S. Pat. No. 4,918,883 on Apr. 24 , 1990.

FIELD OF THE INVENTION

This invention relates in general to the repair of wooden support structures and in particular to the in situ repair of wooden poles or piles subject to a compression load.

BACKGROUND OF THE INVENTION

Wooden poles are widely used for supporting overhead power and communication lines and for piling, both on land and for freshwater and marine environments. The terminology poles as used hereinafter for the purposes of this disclosure includes piles. A great number of these wooden utility poles are in use in remote locations difficult to access by any type of equipment. Although the majority of the poles have been treated to retard decay, a primary reason for replacing such poles is caused by decay at or near groundline. Reasons for decay include preservatives, that do not penetrate to the center of the pole, soil that may contain a particularly aggressive chemical content, or biological agents. The decay or deterioration puts at risk the structural integrity of the pole. Similar damage to the structural integrity of the pole could be caused by accidents, weather, insects, birds, rodents, or other animals. This damage may occur anywhere along the length of the pole and not just at groundline.

Although such damage might not occur to a non-wooden pole, wooden poles are widely utilized because of the ready availability and relative inexpensive of materials. In addition to this, metal poles are also susceptible to damage from weather and ground conditions.

Many methods have been proposed in the prior art for repairing such damaged poles and piling. In the beginning, the unsound member was simply removed and replaced. This can be impractical due to the labor and time consuming requirement for removing the structure or the power or communications lines carried by the poles from service.

One prior method of repair involves reinforcement, which can be done by setting a wooden stub by the weakened member and binding the stub to the member. A variation of this method is also disclosed in U.S. Pat. No. 3,938,293. This patent depicts an apparatus for installing a driven splint adjacent to a weakened pole. The large driving apparatus required and complicated steps of the method are not cost effective, and therefore the method of this patent would rarely be chosen, except for locations that can be easily reached by heavy equipment, and then only for poles where a repair without a disruption of the services or necessity for otherwise supporting or disengaging the power or communications lines is required.

Another prior repair method involves cutting off the pole above the damaged, embedded lower portion, supporting the pole and the power or communications liens that it carries, and then removing and replacing the base of the pole with some type of replacement footing.

An example of this technique is disclosed in U.S. Pat. No. 4,621,950 and its related U.S. Pat. No. 4,618,287. The disadvantages of this method are also readily apparent. In fact this is not an improvement over the method of simply replacing the standing pole because of the need to support the pole during the replacement of the damaged lower end. In addition this method has not been proven to be cost competitive with a simple replacement of the damaged pole with a new pole. The requirement of a large truck mounted with complicated machinery is also shared by these methods.

A similar repair method is disclosed in U.S. Pat. No. 4,033,080, which discloses a method of replacing the lower part of a wooden pole with a concrete segment to be embedded in the ground. In order to make this repair, the existing pole must be cut in two, the upper part of the pole supported, and lower part of the pole pulled from the ground prior to the installation of the concrete base, which is driven into the ground. This method has the same drawbacks as that previously described in U.S. Pat. Nos. 4,618,298 and 4,621,950.

Yet another method is disclosed by U.S. Pat. No. 4,371,018. This reference discloses an apparatus for lengthening or shortening poles. The method involves raising the pole vertically until its lower end is clear of the ground so that a replacement for the lower end can be attached, afterwards the pole and the replacement are joined together, after which the pole and stub are lowered vertically into the ground to the required depth. The ground is then consolidated to complete the repair. In addition to the disadvantages discussed and readily apparent that this method shares in common with the previous descried references, this reference discloses a complicated and expensive device which must be mounted on a heavy piece of equipment and must be used in the field.

SUMMARY OF THE PRESENT INVENTION

The present invention describes a method of repairing wooden support structures, in particular, wooden piling. Although the stresses that are applied to a bridge or trestle piling are difference than those applied to a utility pole, the common denominator to both pilings and poles is the wood of which each is made. Wood pilings deteriorate and decay in the same manner as wood poles, that is, fungal attack or insect attack occurs throughout that three foot section of the piling centered at the groundlines. The remaining strength of this area of the piling can be defined by the percentage of cross-section lost to decay. As with utility poles, the extremely high tensile and shear strength of the composite excludes them from design restrictions. The compressive strength of composites is the limiting factor in designing a restoration system. This invention is especially concerned or related to the repair of these wooden poles which have been damaged by rot at or near the ground surface, and further provides a region of reinforcement for the member for a distance above and below the area of damage. This invention teaches a method of repairing such damaged poles which can be easily done in situ by a small crew of workmen without the need for any complicated or expensive machinery or equipment. This invention, unlike the prior art devices, is therefore particularly suited for use on the many poles that are located in sites inaccessible to transport. The improved repair method of this invention provides a method of repair for all compression loaded piling or poles that can be quickly accomplished with a minimum of manpower and without a disruption of service.

In summary, this invention provides a simple method for repair of wooden support piles or poles which have been damaged by environmental effects which is easily transportable, simple to install with a minimum of hand tools and easily adaptable to any class or height by a simple field measurement.

The invention provides a method of repairing poles (assuming the damaged area is at or near the point where the pile enters the ground) comprising digging around the base of the pole to expose the pole all the way around to a depth of about 3 or 4 feet from the ground surface. Next the pole is cleaned to remove any of the ground material that may adhere to the pole by a means such as scraping or wire brushing. This clean-up includes the step of removing surface decay. Other mechanical or chemical means would also be appropriate, such as sand or air blasting. An important step is to cut away the damaged wood, back to solid, undamaged wood. The cut can either be a curf type cut or can be a clear cut completely around the column in either a wedge shape or column type cut. Next, a high compressive strength liquid but quick setting compressive material is poured into the cutaway area, supported until setting by a temporary form. The pole may be treated with a fumigant which is pumped into the pole through holes dispersed around the decay area. The fumigant kills any biological agents and so adds to the life of the pole. Then a coating is preferably applied to the pole and repair to enhance the bonding of the wrap to the surfaces. Following that, the wrap is applied to the cleaned and repaired area of the pole.

The wrap consists of a series of strips of fiberglass mat in length as long as the area of the pole that has been cleaned or approximately six feet and about a foot and a half in width. These fiberglass strips are saturated with a polyester or epoxy resin, or with a vinyl ester, and then are placed vertically against the cleaned and coated area of the pole and rolled into place with a paint roller. One strip at a time is installed against the pole, and the strips are overlapped by half as the workman proceeds around the pole. The workmen continue in this manner, placing a series of overlapping strips in place and rolling them out against the pole until enough layers are in place to provide the strength required by the size and type of utility pole. The field team can tell when enough layers have been placed by making a simple measurement of the total thickness of the layers of wraps. The wrapped layers may then painted with a ultraviolet resistant coating and the installation of the repair is complete. After the surface of the repair has set, the hole can be filled in and consolidated and the repair of the pole is complete.

For applications where the area to be repaired is above ground, the step of digging down, back filling and consolidating can be omitted, but the remaining steps of cleaning the surface of the pole or pile, cutting back the pole to solid wood, filling the cut-away area with a high compressive strength material, and wrapping a pole are performed as described above.

BRIEF DESCRIPTION OF THE DRAWINGS

FIG. 4 is a segment of a wooden pole repaired with a wedge type repair cut.

FIG. 5 is a segment of a wooden pole prepared with a column type repair cut.

FIG. 6 is a cross section through FIG. 4.

FIG. 7 is a cross section through FIG. 5.

FIG. 8 shows an alternative fiber orientation.

DETAILED DESCRIPTION OF THE PREFERRED EMBODIMENT

The present invention will now be described in more detail with reference to the accompanying drawings.

As previously mentioned, this invention relates to the repair of poles in situ. Primarily, this invention is directed towards the reinforcement or repair of wooden poles decayed because of exposure to ground conditions or weather elements. In addition this method applies to the repair of wooden poles and cross bars that have been structurally compromised or damaged by insects, rodents, birds,(particularly woodpeckers), or any other environmental effect, or impact.

The initial step that must be taken when repairing the insect or animal damage involves the restoration of the original diameter of the pole. The preferred method would be to fill the hole with some high compressive strength material. One illustrative example would be PYRAMENT cement, a quick set cement having a compressive strength of greater than 6,000 psi. This material has a higher compressive strength than the wood of the pole itself, and since the diameter is restored the compressive strength of the pole is restored. In addition, the filler will keep moisture from becoming trapped by filling any voids.

Figure 1:
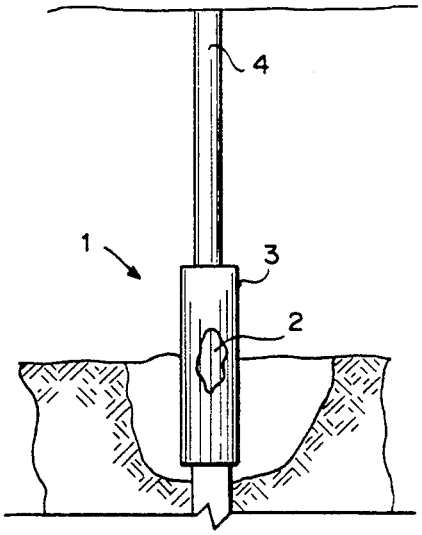
FIG. 1 shows a pole or pile with the apparatus for repair installed.
Figure 3:
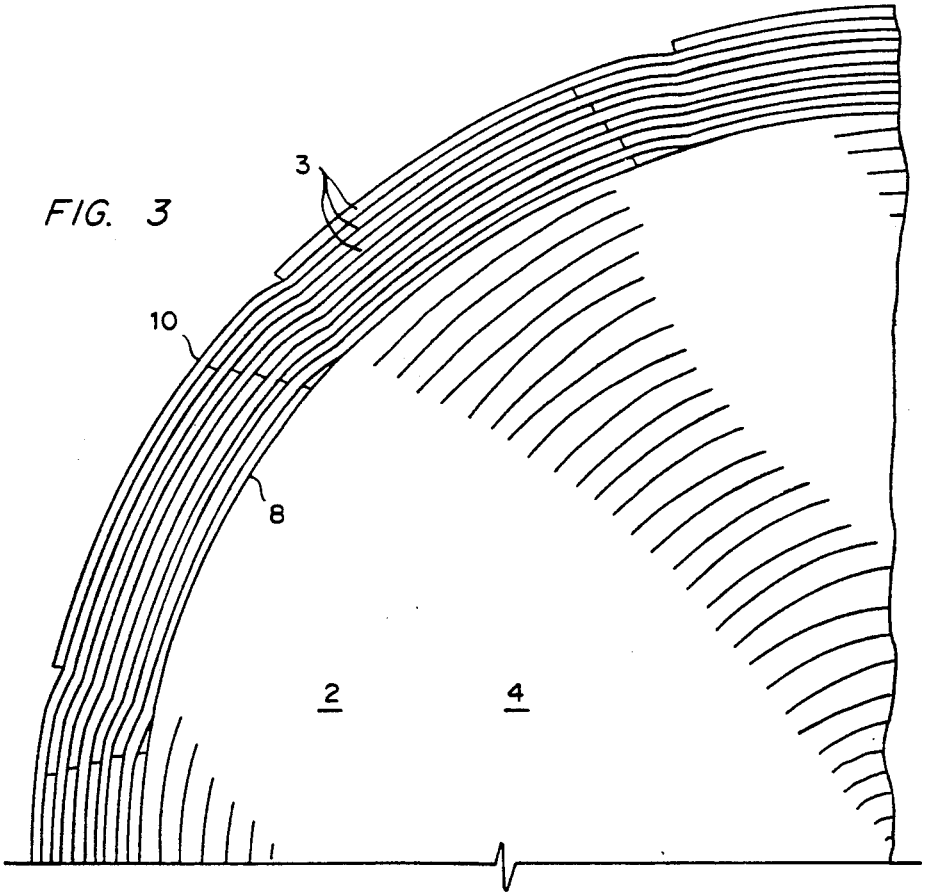
FIG. 3 shows a cross-section of a utility pole and the laminations of the glass mat components.

As shown in FIG. 1 there is an installed composite repair prior to the refilling of the excavation made for the repair. FIGS. 1 and 3 also indicate the area 2 of damage to the pole caused by decay.

Other components of the repair apparatus and method here described, comprise a quantity of fiberglass mats which are supplied in strips 3 of approximately six feet in length by sixteen to eighteen inches in width. This glass is supplied with the primary fibers 5 that will run in the vertical direction parallel with the longitudinal wood fibers of the pole as the strips are installed.

Figure 2:
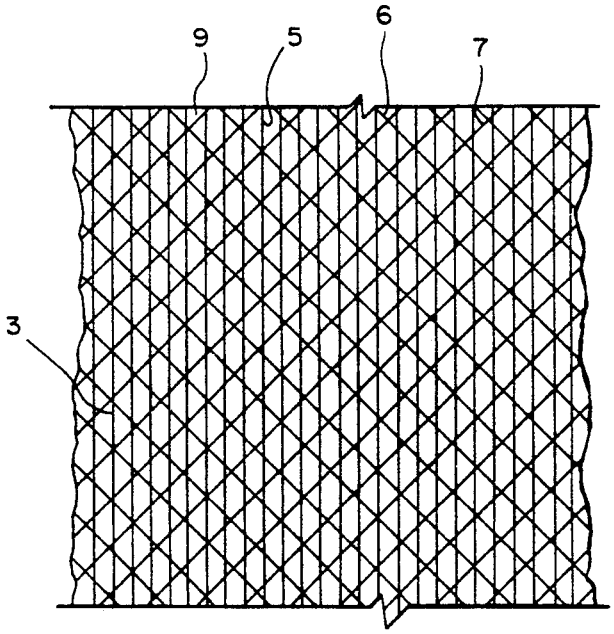
FIG. 2 shows the glass mat component with fiber orientation of the repair kit.

The fiberglass blanket utilized in the primary embodiment of this invention is supplied with 50% of the fibers 5 running in the vertical direction, 25% of the fibers 6 at 45 degrees to those vertical fibers and the remaining 25% of the fibers 7 running at 90 degrees to the second set of fibers, which results in fibers 7 also being placed at 45 degrees to the primary longitudinal fibers 5. FIG. 2. This particular orientation of fibers within the fiberglass blanket is not common in the industry. Although this orientation is the best method now known for arranging the fibers, further research may indicate that the desired placement of the fibers would be in a similar arrangement, but with different percentages. The weight of the glass mat is not particularly important because of the method of installation, which is described in greater detail below. The reason for the arrangement as previously mentioned is that the primary fibers run in the vertical directions to handle the stresses that are transferred to the composite encasement, but in addition to that, there is a need for hoop strength.

One reason the hoop strength is required is because since most of the applications for this repair method are related to wooden poles, installed into the ground, there will be moisture migrating up the pole. The composite repair encapsulates the wooden pole, with a substantially air tight seal to a distance of approximately three feet above the ground. In essence what has occurred is that the ground line has been moved up three feet. The moisture then migrates up that distance. If there is no hoop strength at all, the three feet of the pole above the ground begins to swell from taking on water, and without any hoop strength provided by a horizontal component from the fibers, the composite encapsulation would split apart.

An additional reason that hoop strength is required is due to the repair of the present invention being directed towards poles and piling subject to compressive loads. Regardless of the filler material use, and examples will be described in greater detail below, when the pole and filler material inserted into cut-away portions are subjected to a compressive load at least a certain amount of hoop strength is necessary since material subjected to a vertical compressive load will expand, albeit depending upon the material in some cases imperceptibly, in a lateral direction. In addition, certain types of repair cuts and certain types of installations which do not cut away entirely around the circumference of the pole at the damaged area and fill in with a filler material may require greater hoop strength to retain a wedge shaped plug or filler material in place.

Although this repair is designed for piles and poles subjected to compressive loading, even such poles are subjected at times to tensile stresses, and the compositing casement provides a means for transferring these tensile stresses, a tensile strength margin, across the damaged area of the pole, and a means for retaining any plugs or annular compressive repair materials in place in the event a pole designed for compression loading is subjected to a tensile load outside its structural design expectancy.

As mentioned, it is anticipated that further attention to the design of the orientation of the fibers in the glass mat would indicate that some savings in material could be realized by providing a different orientation. A probable likely design for the compression repair would provide 80% of the fibers running in the horizontal direction for maximum hoop strength with 20% located to provide the necessary tensile strength margin as described above. In other words, 80% of the fibers would be orientated as are the fibers 5, with 10% orientated as fibers(6) and another 10% orientated as fiber 7 of FIG. 8. However, special designed glass would cost more, and until this method is more widely used the expense and redesigning and specially ordering a glass mat would not be worth the expense. At present a fiberglass weave marketed under the name KNYTEX CDB-340 has been found to work well, but equivalents can be selected using the parameters outlined above.

Although the above described orientation of fibers in the glass mat is essentially rotated 90° from that described in the previous application, 07/395,959 and issued U.S. Pat. No. 4,918,883, for simplicity of installation it might be desirable to orient the fibers and use identical mats for the compression repair as for the tensile repair. This would eliminate confusion of workmen in the field and ensure that proper fiber orientation is maintained for the tension repairs where fiber orientation is more critical. The fiber orientation is not a limiting factor in the compression repairs since the structural integrity of the pole is primarily restored by the compressive filler material, and in combination with the cut-away to solid wood.

In addition to the fiberglass mat component of present invention, the invention also comprises a coating 8, a composite resin 9 and in most cases, will also include an exterior ultraviolet resistant coating 10. FIGS. 2 and 3. These components and their placement and purpose will now be further described.

The primary embodiment of the present invention utilizes a coating whose method of application and sequence will be described in more detail below. The purpose of this coating is to enhance the bonding of the composite encasement to the exterior fibers of the utility pole. This invention therefore achieves a bonding which allows for a load transfer both above and below the structurally compromised area from the undamaged portion of the utility pole to the composite installed around the exterior of the pole about the structurally damaged area. For example, as depicted in FIG. 1, if the bad area is 18 inches in length and located as it will be at the ground line, this invention aims to insure that for a minimum area of one or two pole diameters above and below the damaged area, the composite encasement will be well bonded to the surface of the wood pole.

Because the pole subjected to bending stresses loads from the outside not the inside, by providing this encasement about the exterior of a pole, the composite repair can insure a pole that will structurally take at least the same tensile load as an undamaged pole.

The wooden material of these poles typically has a fiber stress of 8000 PSI. The composite repair encasement installed typically has a tensile strength in the nature of 45,000 PSI. By providing a sound bond between the encasement composite repair and the wooden pole, as traverse load is put on the pole and the pole develops bending stresses, they will be transferred to the composite encasement rather than to the structurally compromised area of the pole. Testing indicates that in every case of a pole repaired with the method of this invention, the repaired poles subjected to bending will break at approximately the same locations as a structurally sound, new utility pole will break.

Two basic problems for tensile force transfer require the coating that is applied to enhance the bonding between the encasement and the pole. The first problem is moisture. Moisture exists in the ground, and may have been absorbed in the pole to such a degree that the pole is wet. The second problem necessitating some type of coating to enhance the bonding is that poles or piles are commonly treated with some type of preservative, a common example of which is creosote. Over a period of time the preservative migrates down the pole and tends to migrate out into the soil along the area right at ground line. Generally there will be a considerable amount of whatever preservative the pole was treated with still existing in the portion of the pole at or below ground line, which is the portion of the pole which is subject to structural compromise.

After cleaning and prior to coating, the pole may be treated with fumigant to kill any biological agents. Holes are drilled into the pole; dispersed about the decay area. Next, a fumigant is pumped into the pole, and filler material fills the holes.

Various coatings are appropriate, epoxy, polyurethanes, and shellac. Epoxies are basically impervious to water but sensitive to hydrocarbons, such as the creosote coating preservatives common in utility poles. On the other hand, polyurethanes are impervious to hydrocarbons but sensitive to water. In this respect it is a compromise. There are a variety of both epoxies and polyurethanes on the market and many of them would be suitable for this coating use. The coating may be required to minimize the effect of the moisture within the pole or the preservative upon the composite resin during the curing period. The basic criteria for choosing an epoxy or polyurethanes would be to choose an epoxy that is relatively impervious to hydrocarbons or conversely, to choose a polyurethanes that is not highly sensitive to moisture.

The next component of the composite repair will be the resin 9 itself. FIG.2. Resins generally are either epoxies, polyesters, or vinyl esters. Polyesters are relatively moisture sensitive and if the coating 8 previously described does not achieve a good seal, the result will then be a slow cure between the polyester and the surface of the utility pole.

Although polyesters have been mentioned as a primary embodiment or as the first choice for the primary embodiment, they are followed as closely by epoxies and vinyl esters. These common epoxies or component polyurethanes are readily available in the industry, and as previously discussed, criteria for choosing the components for this composite will be imperviability to moisture, non-susceptibility to compromise from the preservative coatings applied to wooden poles, and the requirement of a good bond between the composite encasement and the surface of the wooden pole.

The last component of the composite encasement of the tension repair is the ultraviolet resistant coating 10. FIG.3.

The ultraviolet resistant coating may be required if the composite encasement is exposed to the weather, and ultraviolet has a deteriorating effect on composite resins over a period of time. As is also commonly known in the industry, there are numerous commercial coatings available for composites to provide resistance to ultraviolet and weather conditions. One example is a Polyene polyurethanes. Although the coating 10 is really only required for the above ground portion of the pole, it would typically be applied to the entire length of the composite encasement.

The components of the composite repair apparatus of the tension repair of the present invention have been described as comprising; a fumigant coating 8 applied to the exterior of the pole 4 to enhance the bonding between the pole 4 and the composite encasement 1, multiple strips of a fiberglass mat 3 with particular fiber (5,6,7) orientation and of approximately 18" width and approximately 6' in length, a composite resin 9 and some type of ultraviolet resistant coating 10. See FIGS. 2 and 3.

Although the approximate dimensions of the fiberglass mat strips have been described and illustrated, the number has not, because the number will vary depending upon the class and height of the pole being repaired, and the degree to which tensile stresses are important.

Wooden poles used in this country are classified for tensile strength in accordance with ANSI 05.1, *Specifications and Dimensions for Wood Poles.* Poles of a given class and height develop the same nominal strength regardless of wood species by providing the circumference (diameter) necessary for each species. Since most of the utility poles are Southern pine or Douglas fir, (which have the same dimensional requirements), these woods have been evaluated for the purposes of patenting this invention. ANSI Pole Classifications identify the lateral load a pole is expected to resist as follows:

TABLE 1

| ANSI 05.1 LATERAL LOADS | |
|---|---|
| Class | Load (lbs) |
| 4 | 2400 |
| 3 | 3000 |
| 2 | 3700 |
| 1 | 4500 |
| H1 | 5400 |
| H2 | 6400 |

The size (circumference) of the poles has been determined by applying the lateral load at a point two feet below the top of the pole and computing the stress at the critical point on the pole, determined by standard principles of engineering.

For the purposes of the present invention, an engineering study was done considering the critical section for this repair system as being at the ground line, assuming that all forces would be carried by the composite encasement and assuming that the pole itself would carry none of the force. In other words, the composite repair system was considered as a splice connecting two independent pieces of pole, as if the pole were completely rotted at the ground line and unable to carry any load. Based upon the result of this type of analysis, the number of layers of strips for a given class pole was then generated by computer analysis.

The thickness requirements for the composite encasement were computed by taking a particular pole length and class, and computing the bending moment at ground line. Using a fiber stress of 8000 PSI it is indicated in ANSI 05.1 for Douglas fir and Southern pine, a minimum ground line diameter was determined. The diameter was consistent with the circumference required by ANSI 05.1 at six feet from the butt of the pole. The bending stress in the composite encasement is computed considering the encasement to have the same diameter as the pole diameter. A limiting vertical casing stress determined by empirical testing, was used in determining the thickness of the composite encasement required for a given pole class and length.

In addition to resisting bending moment, the repair system also transfers lateral load into the lower section of the pole. Therefore, the cross section of the composite encasement must resist the sheering forces. The composite encasement thickness required to resist the sheer is quantified by the formula: $T=2=V/(3.14=Dxf)$, where V equals the anti load dependent on the pole class, D equals the diameter of the composite encasement and f equals the allowable sheer stress, determined from empirical testing).

Although the sheer thickness required was very small for the range investigated it has been conservatively added to the thickness required to resist the bending moment. This approach assumed a linear interaction relationship between the sheer and vertical tension ratios.

To validate the above simple analyses a computer model of the pole casing system was also evaluated. The computer analyses confirmed the suitability of the above described analyses as the resulting stresses were very similar in magnitude.

These computer analyses also confirmed the interaction behavior of the composite encasements in the pole as the pole and the casing work together, or compositely to resist applied forces. To work compositely, the forces in the pole transfer from the pole to the composite encasement. The testing and analyses indicate that to accomplish the load transfers the casing must be bonded to the wood. The minimum length of composite encasement required to transfer the forces is about equal to the pole diameter. For design purposes, two diameters have been selected to account for variations in pole materials and bond stress along the bond length. The transfer length is the overlap of the casing and good quality wood. The normal repair arrangement therefore, as described therefore with the composite encasement extending about three feet above and below grade is suitable for the common pole sizes, for the decay will be limited to the immediate ground line region of the pole. Based upon the above evaluations, the total composite encasement thicknesses required for the normal range of pole classes is exemplified in the following table, which gives thicknesses in multiples of one sixteenth of an inch indicating how a given casing thickness is applicable for a range of pole sizes and classes. For example a half inch composite encasement could be used for a 75 foot class 3 pole or for a thirty five foot class H2 pole.

TABLE 2

| Pole Length (ft) | Ground to Butt | Moment Arm (ft) | Total Shell Thickness Required (1/16 in.) ←Pole Class and ANSI Load (LB)→ 4 2400 | 3 3000 | 2 3700 | 1 4500 | H1 5400 | H2 6400 |
|---|---|---|---|---|---|---|---|---|
| 20 | 4.0 | 14.0 | 5.00 | 5.00 | 6.00 | 6.00 | | |
| 25 | 5.0 | 8.0 | 5.00 | 6.00 | 6.00 | 7.00 | | |
| 30 | 5.5 | 22.5 | 6.00 | 6.00 | 7.00 | 7.00 | | |
| 35 | 6.0 | 27.0 | 6.00 | 6.00 | 7.00 | 7.00 | 8.00 | 8.00 |
| 40 | 6.0 | 32.0 | 6.00 | 7.00 | 7.00 | 8.00 | 8.00 | 9.00 |
| 45 | 6.5 | 36.5 | 7.00 | 7.00 | 8.00 | 8.00 | 9.00 | 9.00 |
| 50 | 7.0 | 41.0 | 7.00 | 7.00 | 8.00 | 8.00 | 9.00 | 9.00 |
| 55 | 7.5 | 45.5 | 7.00 | 8.00 | 8.00 | 9.00 | 9.00 | 10.00 |
| 60 | 8.0 | 50.0 | 7.00 | 8.00 | 8.00 | 9.00 | 9.00 | 10.00 |
| 65 | 8.5 | 54.5 | 7.00 | 8.00 | 8.00 | 9.00 | 10.00 | 10.00 |
| 70 | 9.0 | 59.0 | 8.00 | 8.00 | 9.00 | 9.00 | 10.00 | 10.00 |
| 75 | 9.5 | 63.5 | | 8.00 | 9.00 | 9.00 | 10.00 | 11.00 |
| 80 | 10.0 | 68.0 | | 8.00 | 9.00 | 10.00 | 10.00 | 11.00 |
| 85 | 10.5 | 72.5 | | 9.00 | 9.00 | 10.00 | 10.00 | 11.00 |
| 90 | 11.0 | 77.0 | | 9.00 | 9.00 | 10.00 | 11.00 | 11.00 |
| 95 | 11.0 | 82.0 | | | 10.00 | 10.00 | 11.00 | 11.00 |
| 100 | 11.0 | 87.0 | | | 10.00 | 10.00 | 11.00 | 12.00 |
| 105 | 12.0 | 91.0 | | | 10.00 | 11.00 | 11.00 | 12.00 |
| 110 | 12.0 | 96.0 | | | 10.00 | 11.00 | 11.00 | 12.00 |
| 115 | 12.0 | 101.0 | | | 10.00 | 11.00 | 12.00 | 12.00 |
| 120 | 12.0 | 106.0 | | | 10.00 | 11.00 | 12.00 | 12.00 |
| 125 | 12.0 | 111.0 | | | 11.00 | 11.00 | 12.00 | 13.00 |

As indicated in the above table the number of strips of glass mat required to repair any given pole will vary depending upon the pole's length, class, and design load. The number can be easily determined in the field by a workman with a tape measure, who simply applies strips until the required thickness is reached. The application of the strips will be discussed in further detail below.

The present invention also provides for the composite pole repair method to be used for piling restoration. Pilings deteriorate in much the same manner as utility poles, and restoration of pilings can be performed in the same manner as utility poles.

The allowable unit stresses for the highest strength wood piling (Douglas Fir-Larch) under the best of conditions (19% moisture content) prior to inclusion of a safety factor of 2.5 is as follows:

| | |
|---|---|
| UNIT STRESS IN TENSION | 3125 PSI |
| UNIT STRESS IN SHEAR | 212.5 PSI |
| UNIT STRESS IN COMPRESSION | 3687.5 PSI |

The allowable unit stresses for the composite are as follows:

| | |
|---|---|
| UNIT STRESS IN TENSION | 46.700 PSI |
| UNIT STRESS IN SHEAR | 13.700 PSI |
| UNIT STRESS IN COMPRESSION | 27.900 PSI |

A comparison between the various stresses of wood and the composite show that the lowest ratio is in the compressive loads.

$$\text{RATIO IN TENSION: } \frac{\text{46,000 PSI FOR COMPOSITE}}{\text{3,125 PSI FOR WOOD}} = 14.94/1$$

$$\text{RATIO IN SHEAR: } \frac{\text{13,700 PSI FOR COMPOSITE}}{\text{212.5 PSI FOR WOOD}} = 64.5/1$$

$$\text{RATIO IN COMPRESSION: } \frac{\text{29,900 PSI FOR COMPOSITE}}{\text{3,687.5 PSI FOR WOOD}} = 8.11/1$$

Therefore, to design a composite restoration for a piling the stresses that need to be considered are the compressive loads.

Factors to consider in compression loading a composite restoration are the minimum cross section of composite required to support the maximum load and the bond strength at the interface of wood and composite measured in pounds/sq. in. Calculated values for the cross-section of composite are determined using the American Railway Engineering Association (AREA) evaluation of loads and forces exerted on pilings. The maximum Cooper loading for a timber bridge is designated "E72". This indicates a maximum load of 72,000 lbs. in compression.

The cross-section (sq.in.) of a piling is the basis for the maximum loading capacity. The two piling sizes commonly used are 14"×14" and 14"×12" on the cap end. These reduce to 10"×10" and 10"×8" at 30 feet.

If we assume: 72 000 lbs. MAXIMUM COMPRESSIVE LOAD 14"×12" CAP THEREFORE 10"×8" AT 30 FEET NO WOOD REMAINING AT 30 FOOT POINT

10"×8"=36" PERIMETER

Composite strength in compression −29,000 PSI 72,000 lbs. max. comp. load/29,900 psi=2.4 psi max. load 2.4 psi/36 in perimeter=0.0666 in/inch of perimeter.

This indicates that the required thickness for a maximum compressive loading on the composite is less than is normally applied on a standard restoration since a minimum pole repair is 5/16 or 0.3125 inches.

Another consideration for thickness of the composite is the effect of using fillers beneath the composite. As mentioned above, under compressive loads it might be possible for the filler, expanding laterally, to rupture the composite due to perpendicular loading.

Referring to FIGS. 4 through 8, samples were prepared to determine the effects of filler 8 on the composite. The filler 8 in all test cases set out below were pyrament cement, a quick set cement having a compressive strength of >6000 psi. All tests were performed on creosote treated Southern Yellow Pine poles 9. The poles had a diameter that varied between 9.5 niches to 10.0 inches, and after the below described tests the samples in a standard compression loading press.

The reference in all tests below to triaxial glass 10 refers to the fiberglass weave marketed under the name KNYTEX CDB-340 referred to previously which has 50% of the fibers running in the vertical direction, 25% of the fibers at 45° to the vertical fibers, and the remaining 25% of the fibers running at 90° to the second set of fibers. References to bi-ply glass 11 refer to a common industry standard glass mat of two plies, one side or ply of woven roving and the other side or ply of chopped glass. This bi-ply glass 11 is essentially used to assure that the surface irregularities of a wooden pole are minimized. The bi-ply wrap 11 is installed with the chopped glass side facing the pole, prior to the installation of the triaxial glass 10. The reference below to "inches" of triaxial glass or bi-ply glass is measured around the circumference of the pole, therefore, given the diameter of the pole, and the total number of "inches" of glass, indicates the number of "wraps" of glass, which in turn indicates the thickness of the composite applied to the outside of the pole since the glass thickness itself is approximately 0.042 inches.

Test A: 3 foot pole cut 9.75" diameter wrapped with 166 inches of triaxial glass and 25 inches of bi-ply glass was cut-away illustrated in FIGS. 4 and 6, and the cut-away portion was filled with a quick set cement. The goal of this test was to determine how compression loads on a wedge type repair effects the integrity of the composite wrap.

The maximum loading was −116,800 lbs. at yield, the cross section of the pole was 75 sq. in., failure occurred by crushing of the wood. No changes occurred in the repaired section. The crush strength of the wood was 1,546 lbs./sq. in.

Test B: 3 ft. pole cut, 9.75: diameter wrapped with 332 inches of triaxial glass and 25 inches of bi-ply glass was cut way as illustrated in FIGS. 4 and 6, and the cut-away portion was filled with quick set cement.

This test was also to determine how compressive loading on a wedge type repair effects the integrity of the composite wrap.

The maximum loading was 166,000 lbs. at yield, the cross-section of the pole was 75 sq. in., and failure occurred by crushing of the wood. No change occurred in the repaired section. The crush strength of the wood was 2213 lbs./sq. in.

Test C: 3 ft. pole −9.75" diameter wrapped with 133 inches of triaxial glass and 25 inches of bi-ply glass. The pole was cut away as illustrated in FIGS. 5 and 7, and the cut-away portion was filled with pyrament quick set cement.

This variation was intended to indicate how compressive loading on a column type repair effects the integrity of the composite wrap.

The maximum load was 275,000 lbs. at yield, the crosssection of the pole was −75 sq. in., and failure occurred by crushing of the wood. No change occurred in the repaired section. The crush strength of the wood was 3,666 lbs/sq. in.

Test D: 3 ft. pole 9.75" diameter wrapped with 66 in. of triaxial glass and 25 in. of bi-ply. The pole was cut away as illustrated in FIGS. 5 and 7, and the cut-away portion was filled with pyrament quick set cement.

As with Test C, the goal to determine how compressive loading on a column type repair effects the integrity of the composite wrap. The maximum load was 126,000 lbs. at yield, the cross-section of the pole was 75 sq. in., and failure occurred by crushing of he wood. No change occurred in the repaired section. The crush strength of the wood was 1,680 lbs/sq. in.

In all test (A-D) the wood failed in compression without damage to the repair.

The range of compressive strengths for the wood varied: A—116,800 lbs/(9.75/2)=116,800 lbs/74.6=1565.7 psi; B—166,000 lbs/(9.75/2)=166,000 lbs/74.6=2225.2 psi; C—275,000 lbs/(9.5/2)=275,000 lbs/70.85=3881.4 psi; D—126,000 lbs/(9.75/2)=126,000 lbs/74.6=1689.00 psi. This gives an average compressive strength for southern pine of: 1565.7+2225.2 +3881.4+1689.0=9361.3/4=2340.3 psi.

This compares with a published average maximum value of: 1120.8×2.5=2802 psi.

In sample (A) the cross-section for the composite was : 166 in/9.75/=5.4 layers of triaxial; 5.4×0.042 inches thickness/layer =0.227 inches; 25 inches/9.75=0.816 thickness of bi-ply; 0.816=0.088 inches thickness/-layer=0.072 inches; 0.227"0.072"=0.299 inches total. This thickness is less than 5/16" (0.3125 inches) the minimum that is applied on a standard repair tensile.

The wedge shaped sectioning of the pole as in FIGS. 4 and 6 would exert a maximum loading on the composite, especially if the filler did not totally encompass the remaining solid wood, as in the case of a repair of only one side of a pole. Therefore, the minimum tensile repair thickness is sufficient to hold any filler under compressive loading.

The second factor (bond strength) is addressed in tests E through H. The effects of viscosity of the bonding agent on the overall strength were also tested in test G and H.

Test G: 4 ft. pole 10" diameter, pre-coat: vinyl ester thickened with Cabosil, and wrapped with 166" of triaxial glass and 25" of bi-ply glass. The repair length L along the pole was 36". FIG. 5.

This test was intended to determine effect on bond strength with increased viscosity of undercoat.

The maximum load was 72,800, at (36/2)—1× circumference =17">10=17"×31.4=533.8 sq. in.=136 lbs/sq. in.

Test H: 4 ft. pole —9.5" diameter, pre-coat: vinyl ester thickened with Cabosil, and wrapped with 332" of triaxial glass and 25" of bi-ply glass. The repair length L was 36". FIG. 5.

This test was also intended to determine effect on bond strength with increased viscosity of undercoat. The maximum load 106,000 lbs, at (36/2)—×circumference=17"×9.5=17"×29.8 =506.6 sq. in. This leads to 106,000 lbs/506.6 in. =209.24 lbs/sq. in.

It appears that the bond strength of the material as tested is in the area of 1000-1200 psi. The variation from that value is a result of the percentage of surface contact between the composite and the wood. It would seem from prior industry practice that an increase in viscosity would produce a bonding material which would increase the surface contact. It is apparent from the tests that the change in viscosity of the undercoat was detrimental to bond strength.

The average bond strength for G and H were: 136 lbs/sq. in. 209.24 lbs/sq. in. 345.24/2=172.62 psi. This value is significantly lower than those of previous tests.

Indications from this test show that although an increase in surface contact between the composite and wood was achieved, proper wetting did not occur. Unexpectedly it appears that a lower viscosity than normal may provide a better bond than is currently available.

Tests E and F were run to determine minimum length for composite based upon bond strength.

Test E: 4 ft. pole, 9.5 diameter with a pre-coat of vinyl ester wrapped with 83" triaxial glass and 25" bi-ply glass, along a length L of 36". FIG. 5.

The maximum load was 103,000 lbs at yield, given a surface are of: (36/2) −1"×circumference=17"×9.5=506.6 q. in., this gives 103,000 lbs/506.6 sq. in.=203.3 psi.

Test F: 4 ft. pole, 9.5 diameter with a pre-coat —vinyl ester wrapped with 166" triaxial glass and 25" bi-ply glass, along a length L of 36".

The maximum load was 108,000 lbs. at yield, given a surface area of: (36"/2")−1"×circumference=17"×9.5=506 6 sq. in., this gives 108,000 lbs/506.6 sq. in.=213.2 psi.

The values for tests E and F were averaged as follows: 203.3 +213.2=416.5/2=208.25 psi. If 72,000 maximum compressive load is assumed, a 14"×12" cap =10"×8" at 30 feet with no wood remaining at the 30 foot point and 200 psi bond strength and 10"×8"=36" perimeter gives 72,000 lbs/200 psi=360 sq. in.; which gives 360 sq. in./36" perimeter==10 inches of length for the composite and below the damaged portion.

As stated previously, the stresses that are applied to a bridge or trestle piling are different than those applied to a utility pole, but the common denominator to both pilings and poles is the wood of which each is made. Wood pilings deteriorate and decay in the same manner as wood poles, that is, fungal attack or insect attack occurs throughout that three foot section of the piling centered at the groundline. The remaining strength of this area of the piling can be defined by the percentage of cross-section lost to decay. As with utility poles repair, the extremely high tensile and shear strength of the composite excludes them from design restrictions. The compressive strength of composites is the limiting factor in designing a restoration system.

An apparatus and method according to the present invention for compressing piling repairs would use only a minimum thickness of composite (for example 5/16", the minimum for tensile repairs) to support the maximum compressive strengths exerted on a piling, and only a similar minimum thickness of composite (5/16") is required to retain a filler regardless of the configuration of that filler or its compressive strength. Further, the average bond strength of a composite restoration is sufficient if the length of the restoration above and below the deteriorated area is greater than the longest side of the piling perimeter. Significantly, an increase in viscosity of the bonding agent did not improve the bonding characteristics of the agent. This is probably caused by a lack of wetting of the substrate wood.

When a piling has deteriorated to a dangerous level the required strength can be restored using a composite repair stemming from the composite repairs used upon poles subject to tensile loading.

METHOD OF APPLICATION OF THE PREFERRED EMBODIMENT

The primary embodiment of the present invention comprises a kit with two five gallon buckets, a roll of glass mat, a shovel, and tape measure. Workmen excavate the base of the pole, assuming damage at or near groundline, until they have a hole large and deep enough to work in to clean the pole to a depth of 3 feet below ground line. After they have the hole dug, they will take a wire brush or equivalent to scrape down the pole and restore the surface. Then holes are drilled into the pole and the fumigant is pumped into it. A saw is used to cut away the damaged and/or decayed portions of the pole back to solid wood. For simplicity's sake a column type cut such as in FIGS. 5 and 7 square cutting back to good wood with chain saw is the preferred method. Next, a temporary form is set up and clamped about the pole. This temporary form can be a cardboard tube which can be discarded after use, such as is commonly used for pouring foundation fitters, or it can be a segmented metal sleeve such as is also commonly used in the construction industry for footers and columns. The high strength liquid compressive material is then mixed and poured into the form. Although concrete, in particular PYRAMENT cement or other equivalent fume silica quick setting cement with a compressive strength of greater than 6,000 psi has been listed as the preferred embodiment, any type of resin, concrete, or other type of filler material can be used that has a compressive strength greater than the wood itself, and that does not have any adverse reactions with the bonding agents or resins used in the composite repair. The quick setting filler material is poured into the form, and after it is set the form is removed. Next, the composite wraps are installed. The best method for the repair is to set up a table for working the resin. In general, the table is tray-shaped and sized for the six foot by eighteen foot mat strips required. Generally, the mat is supplied in a roll, and the strips are rolled off and cut at six foot lengths. The resin and the catalyst is mixed on the table, the glass strip is laid into the mix, and then worked with a paint roller, rolled back and forth, until the glass mat is saturated with the resin. As one man is working the resin into the glass mat, another is applying the saturated mat strips to the cleaned portion of the utility pole from approximately three feet below the ground line to three feet above the ground line. The saturated glass mat is placed against the pole, and then rolled with a paint roller to work the glass. When the resin becomes transparent, the workmen know there are no air pockets. The strips are overlapped by hand, beginning on one side of the pole, rolling on the first sheet, then overlapping the next sheet by half, and then proceeding around the pole. Because (for tension repairs) the workmen will be supplied with the information embodied in the table above, which describes the thickness of composite encasement required for any given class and length pole, the saturated glass strips are applied until the desired composite encasement thickness has been reached. For compression repairs strips are applied to the minimum 5/16" thickness. The workmen who are responsible for applying the saturated glass strips can then move their saturation table and the buckets to the next pole where the workman with the shovel already has the hole completed. By the time the workmen have moved and reset their saturation table, the composite encasement applied to the previous pole will be ready for the application of the ultraviolet inhibiting coating and the hole can be filled back in within 15 minutes of that application. This method and apparatus can also be utilized under water, important for many piling repairs. Pouring cement under water is known in the art, as are special polyurethanes water activated components for the composite wraps.

An additional advantage of this method of application over the prior art repair systems, is that in the even poles are equipped with ground wires, small wooden molding, disconnects, switch handles, riser pipes, and other devices of a like nature. Any type of mechanical device repair system would require the complete disassembly of the above mentioned devices. With the composite repair system of the present invention, any attachment to the utility pole has only to be pulled out enough to be able to cut away the pole to solid wood, set up the forms, pour in the filler material, and slip a sheet of saturated glass material behind it.

The entire process, including digging the holes, takes a very short time depending upon how efficient the workmen are. This time includes up to an hour for the digging of the hole, so the time savings, as compared to prior techniques are readily apparent, as are the differences in equipment required A further advantage that the repair system of this invention exhibits over prior devices, is that in many cases a pole is installed so closely to building or concrete footings or the like that there is not enough clearance all the way around the pole for prior art encasement methods. The method of this invention requires only the width of the fiberglass plus perhaps, a few inches of space to work the glass. An additional advantage exhibited by the repair technique of the present invention is that a fumigant to kill bacteria and fungus can be injected into the rotted area of the pole. Once such a fumigant has been injected, and the composite encasement applied, the fumigant is sealed within that area and it will permeate the wood. Being encapsulated, the fumigant will not escape from the pole and will last much longer in contrast to the non-encapsulated splinting type prior art repair methods.

It is to be understood that many combinations and subcombinations of the concepts taught by this specification will be obvious to those in the art. As many possible embodiments of this invention may be made without departing from the spirit or scope, it is to be understood that all matters set forth are shown in the accompanying drawings, but to be interpreted as illustrative and not in a limiting sense.

What is claimed is:

1. A composite repair encasement apparatus for poles comprising:

(a) a plurality of woven glass mat strips;

(b) a liquid resin for saturation of the woven mat strips which subsequently hardens to form, in combination with the mat strips, a fiberglass encasement repair cylinder for a pole;

(c) a bonding agent for application to the pole prior to the installation of the saturated woven mat strips;

(d) a fumigant pumped into the pole to arrest biological agents;

(e) an ultraviolet resistant coating for application to the exterior of the encasement; and, (f) a liquid quick setting high compressive strength filler material.

2. The composite repair encasement apparatus of claim 1 wherein the bonding agent is epoxy.

3. The composite repair encasement apparatus of claim 1 wherein the bonding agent is polyurethane.

4. The invention of claim 1 wherein the woven glass mat material comprises strips cut from a roll of woven glass mat.

5. The invention of claim 1 where the woven glass mat strips are woven from fibers with approximately 50% of the woven fibers running longitudinally along the length of the strip and with approximately 25% of the woven fibers placed at a 45 degree angle to the longitudinal fibers, and the remaining 25% of the woven fibers placed at an opposite 45 degree angle to the longitudinal fibers relative to the first set of angled fibers.

6. The invention of claim 1 where the resin is a two component epoxy.

7. The invention of claim 1 where the resin is a polyester.

8. The invention of claim 6 where the two component epoxy is epoxide resin and polyamide catalyst.

9. The invention of claim 7 where the polyester is unsaturated polyester resin in styrene.

10. The invention of claim 1 wherein the bonding agent is the same composition as the liquid resin.

11. The invention of claim 2 where the bonding agent is bisphenol A and polyamide catalyst.

12. The invention of claim 3 wherein the bonding agent is a copolymer of polyiso cyanates and polyols with hydrocarbon extenders.

13. The invention of claim 1 wherein:

(a) the bonding agent is epoxy;

(b) the woven glass mat material comprises strips cut from a roll of woven glass material; and, 50% of the woven fibers running along the length of the strips and with 25% of the woven fibers placed at 45 degree angle to longitudinal fibers, and remaining 25% of woven fibers placed at an opposite 45 degree angle to longitudinal fibers relative to first set of angled fibers; and, (c) the resin composite is a two component epoxy.

14. The invention of claim 1 wherein:

(a) the bonding agent is epoxy;

(b) the woven glass material comprises strips cut from a roll of woven glass material; and, 50% of woven fibers running along the length of strips and with 25% of woven fibers placed at 45 degree angle to longitudinal fibers, and remaining 25% of woven fibers placed at an opposite 45 degree angle to longitudinal fibers relative to first set of angled fibers; and, (c) the resin composite is a polyester.

15. The invention of claim 1 wherein:

(a) the bonding agent is urethane;

(b) the woven glass material comprises strips cut from a roll of woven glass material; and, 50% of woven fibers running along the length of strips and with 25% of woven fibers placed at 45 degree angle to longitudinal fibers, and remaining 25% of woven fibers placed at an opposite 45 degree angle to longitudinal fibers relative to first set of angled fibers; and, (c) the resin component is a two component epoxy.

16. The invention of claim 1 wherein:

(a) the bonding agent is urethane;

(b) the woven glass material comprises strips cut from a roll of woven glass material; and, 50% of woven fibers running along the length of strips and with 25% of woven fibers placed at 45 degree angle to longitudinal fibers, and remaining 25% of woven fibers placed at an opposite 45 degree angle to longitudinal fibers relative to first set of angled fibers; and, (c) the resin is a polyester.

17. The invention of claim 1 wherein the liquid quick setting high compressive strength filler material is a controlled setting high earlier strength hydraulic cement.

18. A method of repairing poles comprising the steps of:

(a) cutting out the portion of poles to be repaired;

(b) filling in said cut-out portion with a quick setting high compressive strength filler material;

(c) cleaning the surface of the pole;

(d) drilling holes into the pole and pumping a fumigant into the pole;

(e) treating the cleaned surface with a bonding agent;

(f) saturating woven glass mat strips with a composite resin;

(g) applying saturated strips to the cleaned and treated surface to form a cylindrical encasement of desired thickness; and, (h) applying a ultraviolet resistant coating to the exterior of the cylindrical encasement.

19. A method of repairing utility poles in situ comprising the steps of:

(a) excavating around the utility pole which is embedded in the ground to a pre-determined depth;

(b) cutting out the portion of poles to be repaired;

(c) filling in said cut-out portion with a quick setting high compressive strength filler material;

(d) cleaning the surface of pole;

(e) treat cleaned surface with bonding agent;

(f) applying the saturated strips to the cleaned and treated surface to form a cylindrical encasement of desired thickness; and, (g) applying ultraviolet resistant coating to the exterior of the cylindrical encasement.

20. The invention of claim 19 where the application of the saturated woven mat strips is done in a controlled manner.

21. The invention of claim 20 where the controlled manner of applying the saturated woven mat strips is:

(a) insuring that the woven mat strip is fully saturated by placing the woven mat into a tray filled with the liquid composite and rolling the mat strip with a paint roller;

(b) removing the saturated mat strips from the tray and aligning it with the longitudinal axis of the utility pole and then pressing it against the cleaned and treated surface of the utility pole at the repair location;

(c) rolling the saturated woven mat strips with a paint roller to press the saturated mat strip against the cleaned and treated utility pole surface and to ensure that no air bubbles are entrained;

(d) repeating the process with the next woven mat strip which is saturated in the tray, and then placed against the utility pole so that one half of the width of the second mat strip overlaps half of the first mat strip already in place;

(e) rolling the second mat strip with the paint roller to ensure that no air bubbles are entrained;

(f) repeating the saturated mat strip application until the composite encasement cylinder shell reaches the desired thickness; and, (g) applying an ultraviolet resistant coating.

* * * * *